US006322069B1

(12) United States Patent
Krucinski et al.

(10) Patent No.: US 6,322,069 B1
(45) Date of Patent: Nov. 27, 2001

(54) INTERPAPER SPACING CONTROL IN A MEDIA HANDLING SYSTEM

(75) Inventors: Martin Krucinski, Webster, NY (US); Carlo Cloet; Masayoshi Tomizuka, both of Berkeley, CA (US); Roberto Horowitz, El Cerrito, CA (US); Sudhendu Rai, Penfield; David R. Kamprath, Webster, both of NY (US); Perry Y. Li, Minneapolis, MN (US)

(73) Assignee: Xerox Corporation, Stamford, CT (US)

( * ) Notice: Subject to any disclaimer, the term of this patent is extended or adjusted under 35 U.S.C. 154(b) by 0 days.

(21) Appl. No.: 09/267,029

(22) Filed: Mar. 12, 1999

(51) Int. Cl.[7] ..... B65H 5/34

(52) U.S. Cl. ..... 271/265.02; 271/258.01; 271/202

(58) Field of Search ..... 271/258.01, 258.02, 271/265.01, 265.02, 202, 176

(56) References Cited

U.S. PATENT DOCUMENTS 4,171,130 * 10/1979 Jeschke et al. ..... 271/10.03
4,235,431 * 11/1980 Abrams et al. ..... 271/10.03
4,331,328 * 5/1982 Fasig ..... 271/270
4,691,912 * 9/1987 Gillmann ..... 271/10.02
5,129,641 * 7/1992 Long ..... 271/6
5,257,070 10/1993 Miller et al. ..... 355/207
5,328,168 * 7/1994 Fox ..... 271/259
5,407,191 * 4/1995 Ukai ..... 271/227
5,423,527 * 6/1995 Tranquilla ..... 271/10.02
5,471,290 * 11/1995 Nagayama et al. ..... 399/371
5,482,265 * 1/1996 Nakazato et al. ..... 271/242
5,575,466 * 11/1996 Tranquilla ..... 271/10.03
5,689,795 * 11/1997 Mastrandrea ..... 399/407

* cited by examiner

*Primary Examiner*—Donald P. Walsh
*Assistant Examiner*—D Schlak
(74) *Attorney, Agent, or Firm*—Ronald F. Chapuran

(57) ABSTRACT

A method of synchronizing the arrival of copy sheets at a photoreceptor in an image processing having a copy sheet path having a plurality of segments coupled at given transfer zones, a plurality of copy sheet drives, an image transfer station, a photoreceptor and a controller. The controller directs the image processing apparatus by tracking the movement of copy sheets at the image transfer station in relation to the movement of the photoreceptor, monitoring the movement of copy sheets at the transfer zones, determining the need to adjust the spacing of copy sheets along the plurality of segments of the copy sheet path, and suitably activating selected copy sheet drives.

9 Claims, 4 Drawing Sheets

INTERPAPER SPACING CONTROL IN A MEDIA HANDLING SYSTEM

This invention was made in part with Government support under Grant (Contract) No. CMS-9632828 awarded by the National Science Foundation. The Government has certain rights to this invention.

FIELD OF THE PRESENT INVENTION

The present invention is directed to interpaper spacing control in a media handling system, and more specifically, to a control strategy that alternates between interpaper spacing control and velocity tracking.

BACKGROUND OF THE PRESENT INVENTION

The goal of a paper path system in a typical xerographic printing system is to transport media from a feeding unit in synchronism with a moving image bearing photoreceptor surface. The movement of the media to a transfer zone necessarily must arrive at the transfer zone at a given time and with a given velocity to match the velocity of the image bearing photoreceptor surface. Prior art systems are often open loop systems with the media running at a specific speed and position adjustment being made at a transfer registration station just prior to transfer. A difficulty with such systems is the often erratic and abrupt adjustments that must be made at the registration station due to the unpredictability of photoreceptor and media drives and the uncertainty of the position of the image on the photoreceptor. With little time and space for adjustment, the correction can be erratic. This is particularly true in higher speed, higher volume machines.

It is known in the prior art, for example, U.S. Pat. Nos. 5,328,168 and 5,257,070 to selectively activate copy sheet drives after a machine jam in order to position copy sheets for favorable jam clearance including the steps of maintaining a predetermined interdocument space between copy sheets and systematically purging copy sheets from zones of the paper path in a predetermined order.

A difficulty with these prior art systems, however, is the restriction of the systems to jam recovery. Other prior art systems are inadequate to provide for a smooth flow of copy sheets to a registration station, but require relatively abnormal and uncertain adjustments within a relatively narrow adjustment time frame and space. It would be desirable, therefore, to provide a relatively smooth and more accurate adjustment technique over the entire paper path to synchronize the arrival of copy sheets and images on a photoreceptor at an image transfer station.

It is an object of the present invention, therefore, to treat the paper path as a sequence of separate paper path modules and to impose restraints upon the modules dependent upon the placement of copy sheets within the modules. It is another object of the present invention to move copy sheets within the same module at the same velocity and to synchronize the velocity of modules sharing communication with the same copy sheet. It is still another object of the present invention to adjust spacing between copy sheets only when one of the copy sheets is not in a transition zone between two modules. Further advantages of the present invention will become apparent as the following description proceeds, and the features characterizing the invention will be pointed out with particularity in the claims annexed to and forming a part of this specification.

SUMMARY OF THE PRESENT INVENTION

A method of synchronizing the arrival of copy sheets at a photoreceptor in an image processing apparatus having a copy sheet path having a plurality of segments coupled at given transfer zones. The image processing apparatus also includes a plurality of copy sheet drives, an image transfer station, a photoreceptor and a controller. The controller directs the image processing apparatus by tracking the movement of copy sheets at the image transfer station in relation to the movement of the photoreceptor, monitoring the movement of copy sheets at the transfer zones, determining the need to adjust the spacing of copy sheets along the plurality of segments of the copy sheet path, and suitably activating selected copy sheet drives.

BRIEF DESCRIPTION OF THE DRAWINGS

The following is a brief description of the drawings used to describe the present invention, and thus, these drawings are being presented for illustrative purposes only and thus should not be limitative of the scope of the present invention, wherein.

DETAILED DESCRIPTION OF THE PRESENT INVENTION

Figure 1:
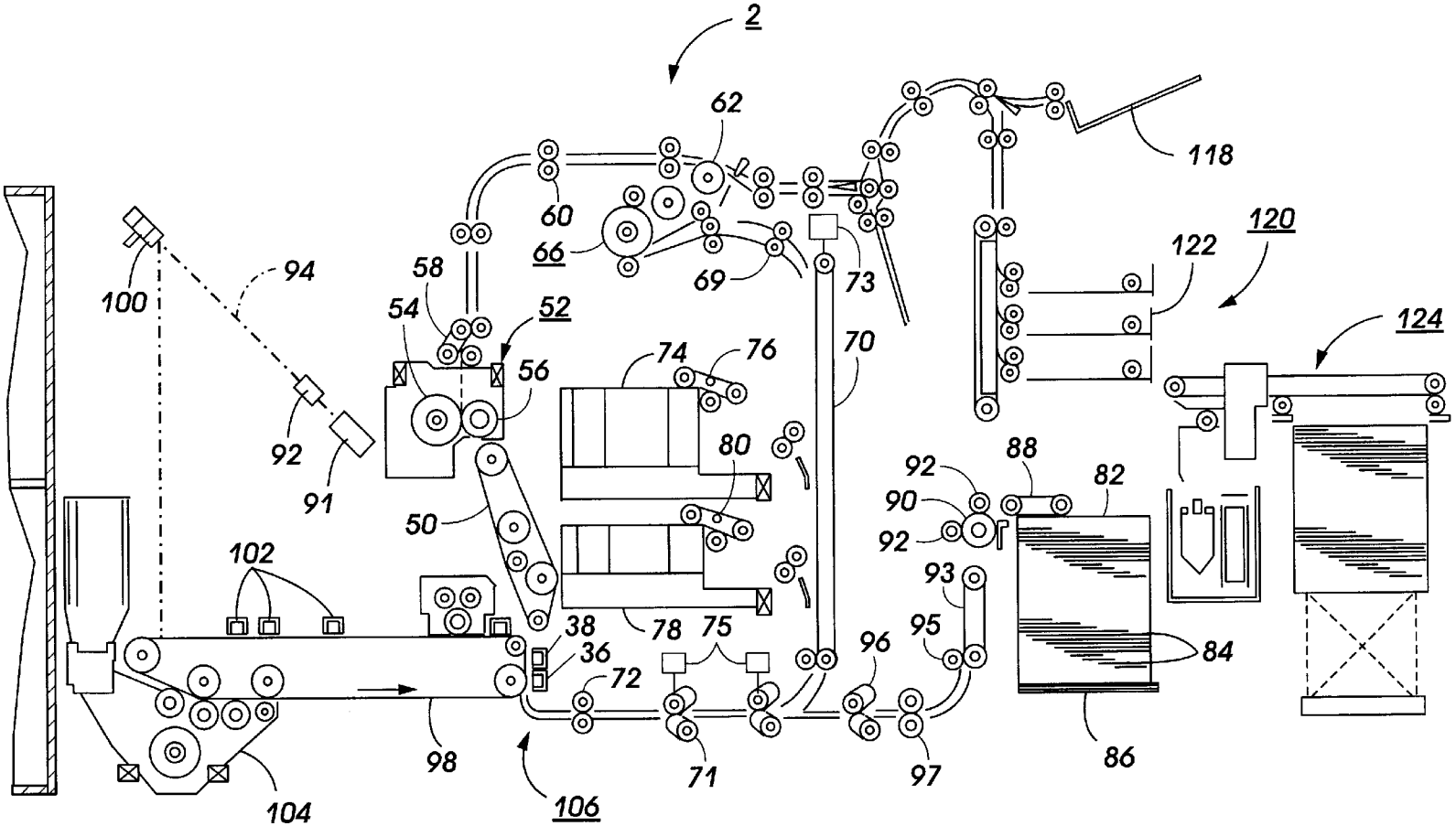
FIG. 1 is a plan view illustrating a typical printing system incorporating the present invention.

Referring to FIG. 1, there is shown an exemplary laser based printing system 2 for processing print jobs in accordance with the teachings of the present invention. Printing system 2 for purposes of explanation is divided into a controller section and a printer section. While a specific printing system is shown and described, the present invention may be used with other types of printing systems such as ink jet, ionographic, etc.

The printer section comprises a laser type printer and for purposes of explanation is separated into a Raster Output Scanner (ROS) section, Print Module Section, Paper Supply Section, and Finisher. The ROS has a laser 91, the beam of which is split into two imaging beams 94. Each beam 94 is modulated in accordance with the content of an image signal input by acousto-optic modulator 92 to provide dual imaging beam 94. Beams 94 are scanned across a moving photoreceptor 98 of the Print Module by the mirrored facets of a rotating polygon 100 to expose two image lines on photoreceptor 98 which each scan and create the latent electrostatic images represented by the image signal input to modulator 92. Photoreceptor 98 is uniformly charged by corotrons 102 at a charging station preparatory to exposure by imaging beams 94. The latent electrostatic images are developed by developer 104 and transferred at transfer station 106 to print media delivered by the Paper Supply section. Print media, as will appear, may comprise any of a variety of sheet sizes, types, and colors. For transfer, the print media or copy sheet is brought forward in timed registration with the developed image on photoreceptor 98 from either a main paper tray high capacity feeder 82 or from auxiliary or secondary paper trays 74 or 78.

A copy sheet is provided via de-skew rollers 71 and copy sheet feed roller 72. At the transfer station 106, the photoconductive belt 98 is exposed to a pretransfer light from a lamp (not shown) to reduce the attraction between photoconductive belt and the toner powder image. Next, a corona generating device 36 charges the copy sheet to the proper magnitude and polarity so that the copy sheet is tacked to photoconductive belt and the toner powder image attracted from the photoconductive belt to the copy sheet. After transfer, corona generator 38 charges the copy sheet to the opposite polarity to de-tack the copy sheet from belt.

Following transfer, a conveyor 50 advances the copy sheet bearing the transferred image to the fusing station where a fuser assembly indicated generally by the reference numeral 52 permanently affixes the toner powder image to the copy sheet. Preferably, fuser assembly 52 includes a heated fuser roller 54 and a pressure roller 56 with the powder image on the copy sheet contacting fuser roller 54.

After fusing, the copy sheets are fed through a decurler 58 to remove any curl. Forwarding rollers 60 then advance the sheet via duplex turn roll 62 to a gate which guides the sheet to output tray 118, finishing station 120 or to duplex inverter 66. The duplex inverter 66 provides a temporary wait station for each sheet that has been printed on one side and on which an image will be subsequently printed on the opposite side. Each sheet is held in the duplex inverter 66 face down until feed time occurs.

To complete duplex copying, the simplex sheet in the inverter 66 is fed back to the transfer station 106 via conveyor 70, de-skew rollers 71 and paper feed rollers 72 for transfer of the second toner powder image to the opposed sides of the copy sheets. The duplex sheet is then fed through the same path as the simplex sheet to be advanced to the finishing station which includes a stitcher and a thermal binder.

Copy sheets are supplied from the secondary tray 74 by sheet feeder 76 or from secondary tray 78 by sheet feeder 80. Sheet feeders 76, 80 are friction retard feeders utilizing a feed belt and take-away rolls to advance successive copy sheets to transport 70 which advances the sheets to rolls 72 and then to the transfer section.

A high capacity feeder 82 is the primary source of copy sheets. Tray 84 of feeder 82 is supported on an elevator 86 for up and down movement and has a vacuum feed belt 88 to feed successive uppermost sheets from the stack of sheets in tray 84 to a take away drive roll 90 and idler rolls 92. Rolls 90, 92 guide the sheet onto transport 93 which in cooperation with idler roll 95, de-skew rollers 96 and paper feed rollers 97 move the sheet to the transfer station via de-skew rollers 71 and feed rollers 72.

Figure 2:
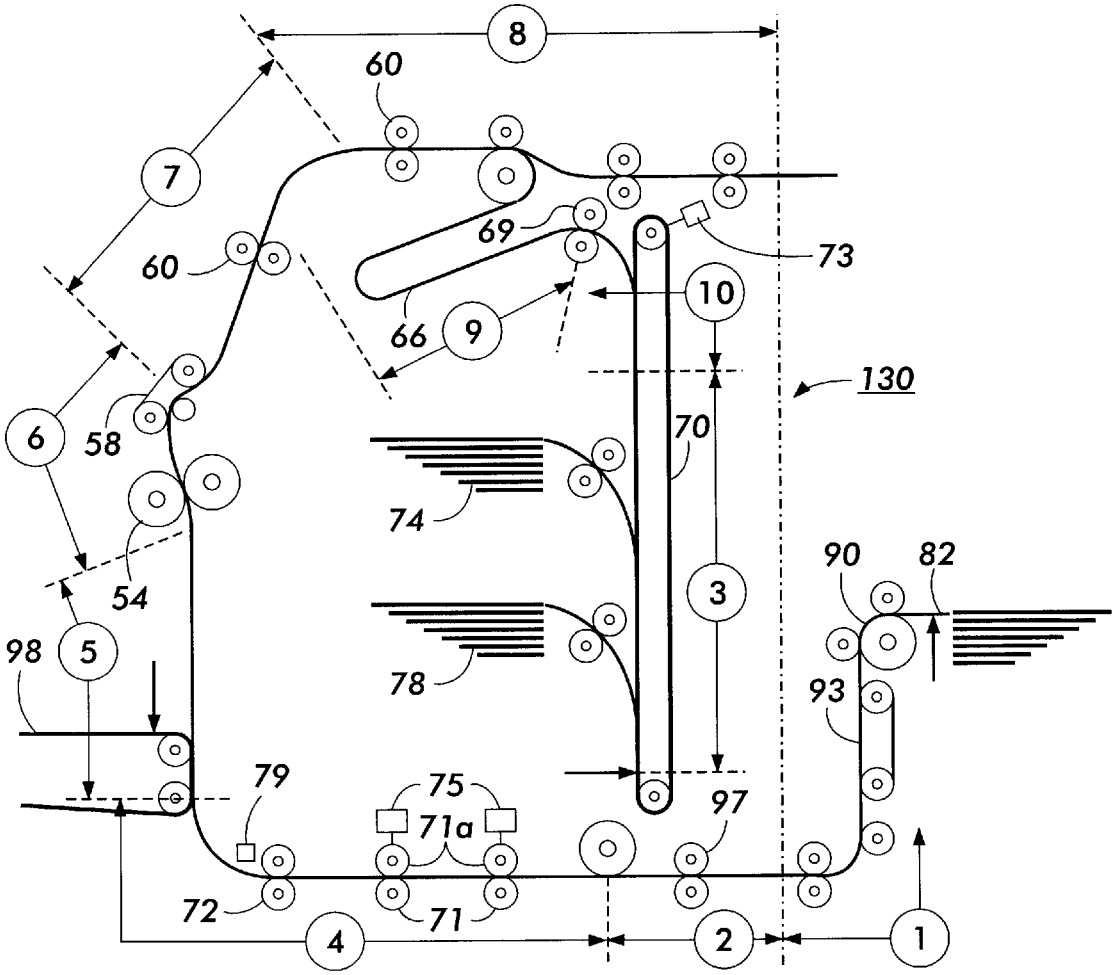
FIG. 2 is an extended view of the copy sheet path.

With reference to FIG. 2 an enlarged sketch of the copy sheet path is illustrated with ten predetermined copy sheet paths zones. The zones are identified by the circled numbers, and are defined by the arrows extending from the circled numbers between dotted lines. The dashed line 130 illustrates the interface between the copy handling module and the finisher station 120. Zones 1 and 2 illustrate the copy sheet path from the high capacity feeder 82 to de-skew rollers 71, zone 3 illustrates the copy sheet path along conveyor or transport 70, zone 4 illustrates the copy sheet path from the de-skew rollers 71 to the transfer station, 106. Zone 5 illustrates the copy sheet path between the transfer station and the fuser 52, zone 6 illustrates the copy sheet path from the fuser to decurler 58, zone 7 illustrates the copy sheet path between the decurler 58 and the rollers 60, zone 8 illustrates the copy sheet path from the rollers 60 to the finishing station, zone 9 illustrates the copy sheet path from the duplex invertor 66 to the duplex feed rolls, and zone 10 illustrates the copy sheet path between the duplex feed rolls 69 and the top of the conveyor 70.

It should be noted that the partitions of the copy sheet path into the zones is arbitrary. However, in accordance with the present invention, certain portions of the copy sheet path are independently driven and are adapted to be selectively turned on or off through the operation of motor, solenoids and clutch mechanisms. For example, a suitable clutch 73 mechanically connected to the transport or conveyor 70 controls the movement of the conveyor 70 and suitable solenoids 75 operate to selectively engage and disengage the de-skew rollers 71.

Figure 3:
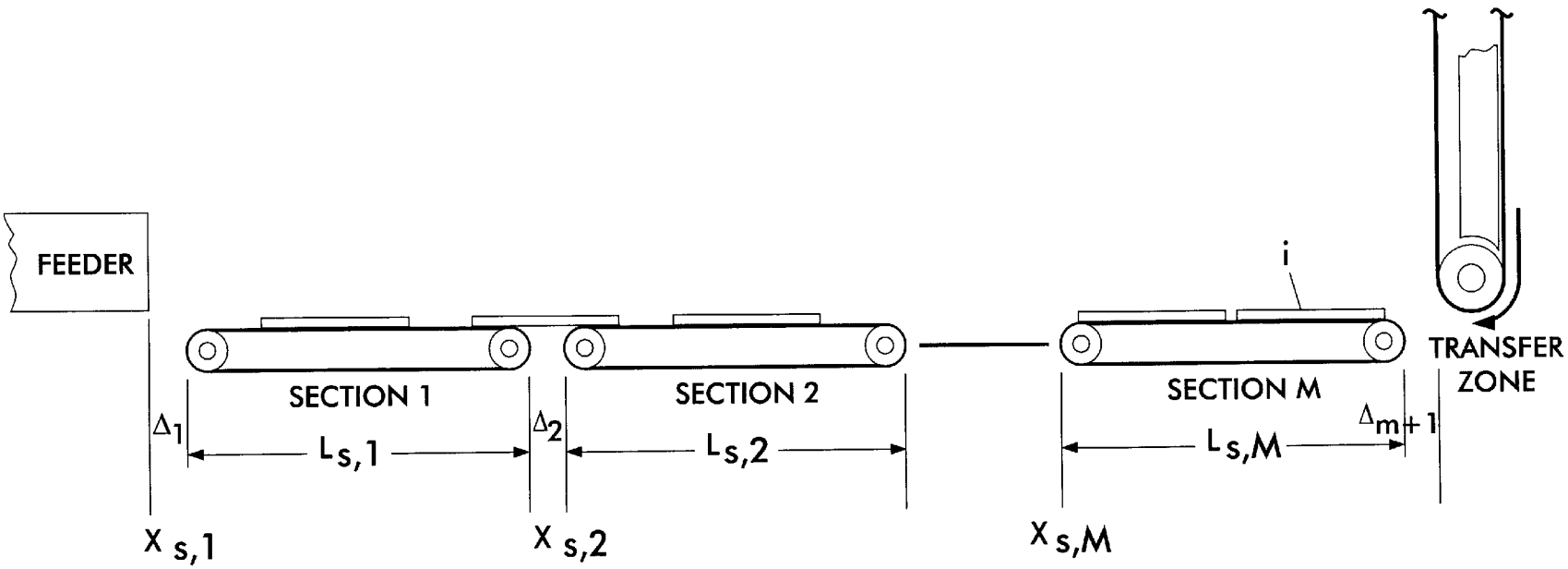
FIG. 3 is a detailed portion of a copy sheet path illustrating the present invention.

The goal of the paper path system is to transport media from the feeding unit to the transfer station or zone such that the media arrives at a given time and with a given velocity to match the velocity of the image carrying belt. Actuators or drives for transporting the media are laid out along the entire paper path. The actuators may be coupled in a modular fashion such that once one or more sheets are within a module or zone, then they all move at the same velocity. The arrangement is shown in FIG. 3. The arrangement imposes two constraints on the controller.

Velocity constraints on the sheets. Objects in the same module or zone move at the same velocity (assuming no slipping).

Velocity constraints on the modules. When one sheet is in contact with several modules, the velocities of these modules need to be synchronized. The controller needs to actively impose this constraint.

The general idea underlying the object spacing control algorithm is the observation that in a general paper path, the spacing between objects can be controlled only if they are in different modules. The spacing between objects in the same module cannot be controlled. Right before a sheet is transferred to a new module or zone, there exists a time window during which its spacing to the sheet in front of it can be adjusted. Outside this time window, the velocity of the sheet is determined by the control action for the most downstream sheet in its module.

The control scheme starts with module or section M, the module right before the image transfer station or zone. Module M assumes the previous sheet entered the image transfer station with zero error. Therefore, when doing sheet spacing control, the sheet will arrive in time at the image transfer station if it can obtain zero interpaper spacing error with the sheet that previously entered the image transfer station. This is because the desired interpaper spacing corresponds to the spacing between images on the photoreceptor belt. The velocity of the module M is controlled in such a way that the spacing between the most downstream sheet in the module, sheet i, to the previous sheet entering the image transfer station, is kept as close to the desired position as possible. Module M stays in the sheet spacing control until the sheet i arrives at the transfer module. The controller then switches to tracking control where the velocity of the module M, is controlled to track the photoreceptor speed $V_{di}$ which is constant. When the trailing edge of the sheet i leaves module M, the process repeats itself with the next following sheet becoming sheet i, etc.

For modules 1 to (M−1), the idea basically remains the same. The only difference is that the velocity of the downstream modules $s_{i+1}(t)$ is no longer constant. Instead, it can vary between $S_{min.i+1}$ and $s_{max.i+1}$. To fulfill the constraints described above, a master/slave relationship is determined between any two neighboring modules. When an object is being transferred to a downstream module, the upstream module must synchronize its velocity, $s_i(t)$, with that of the downstream section, $s_{i+1}(t)$. Therefore, the upstream module becomes the slave and the downstream module the master. In the extreme case that sheets are being transferred between all modules in the machine simultaneously, the transfer unit dictates the speed and all the modules are required to run at $s_i(t)=V_$. The same control strategy is used between the feeding unit and the transport modules. The feeder is equipped with an overrunning clutch. This allows the first section to pull the sheet out of the feeder in case it is running faster than the feeder speed. In the other case, an acceptable buckle will form.

Figure 4:
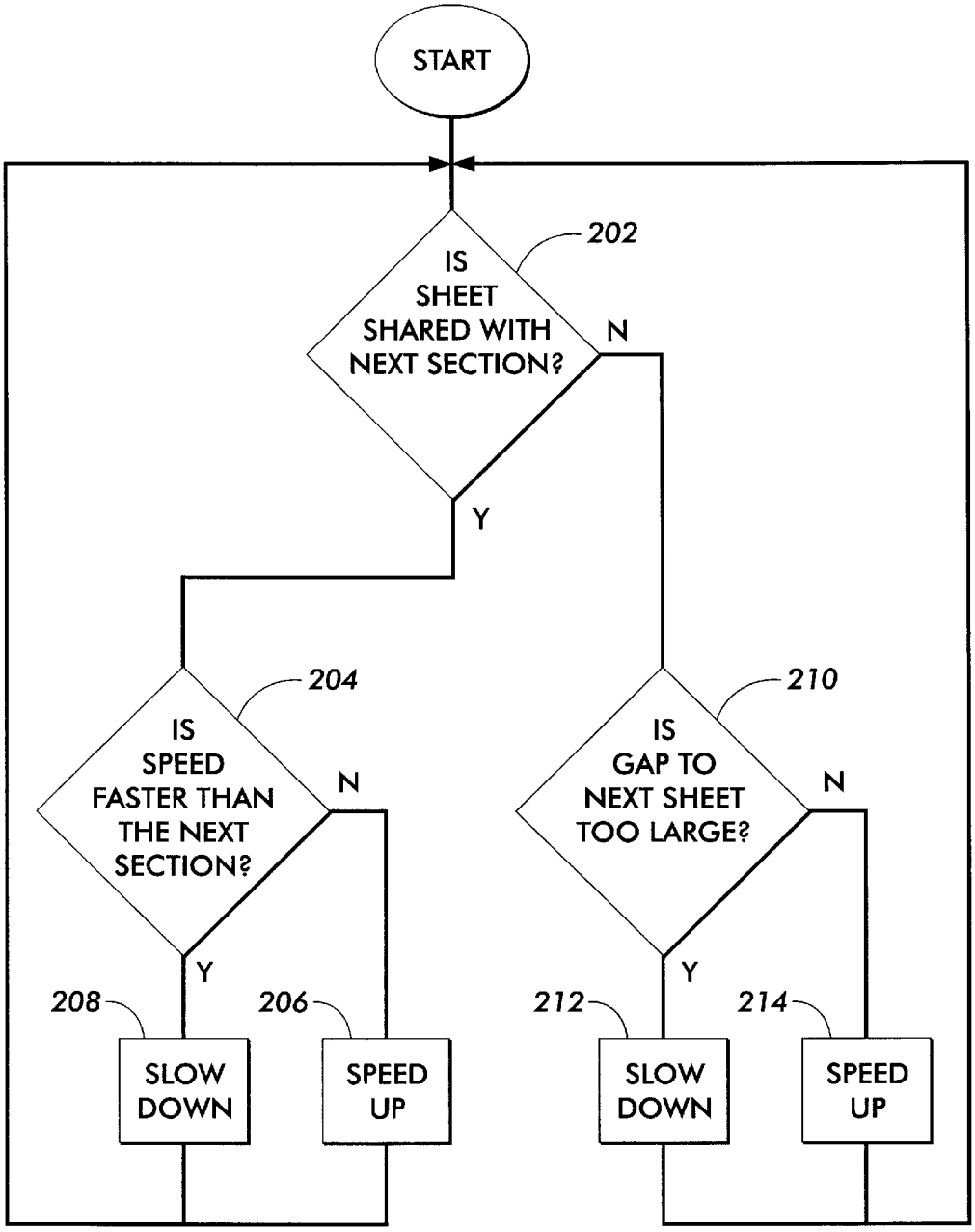
FIG. 4 is a flowchart illustrating copy sheet control according to the present invention.

With reference to FIG. 4, there is shown a flow chart illustrating the present invention. In particular, at decision block 202, there is a determination whether or not a sheet in the copy sheet path is shared with another copy sheet path section. If yes, then there is a determination as to whether or not the speed of that copy sheet is greater than the speed of the movement of copy sheets in the next section. This is shown in decision block 204. If no, then, as shown at block 206 there is a speed up of the copy sheet. If the speed is faster than the speed of copy sheets at the next section, then as shown at block 208 there is a slow down of the speed of the copy sheet.

On the other hand, if the sheet is not shared with the next section, then there is a determination as shown in the decision block 210 whether or not the gap to the next sheet is too large. If the gap is too large, then as shown at block 212, the speed of the copy sheet is increased. On the other hand, if the gap is not too large, then the speed of the copy sheet is decreased as shown at block 214.

While the present invention has been described with reference to various embodiments as described above, it is not confined to the details set forth above, but is intended to cover such modifications or changes as may come within the scope to the attached claims.

What is claimed is:

1. In an image processing apparatus for producing images on copy sheets including a copy sheet path having a plurality of selectively controlled segments with transfer zones, each segment with a transfer zone having a corresponding copy sheet drive to adjust copy sheet spacing and a controller for directing the image processing apparatus, a method of maintaining spacing between copy sheets along the copy sheet path comprising the steps of:

tracking the movement of a copy sheet at said plurality of segments with transfer zones to specify the degree of spacing of the copy sheet from a next downstream copy sheet for each of said plurality of segments, determining the need to adjust the spacing of the copy sheet from the next downstream copy sheet, and activating selected copy sheet drives for said plurality of segments in order to adjust the spacing of the copy sheet from the next downstream copy sheet for a selected one of said plurality of segments.

2. The method of claim 1 including the step of determining correct spacing of copy sheets from next downstream copy sheets and maintaining the speed of upstream copy sheets in step with the speed of downstream copy sheets.

3. The method of claim 1 wherein the image processing apparatus includes an image transfer station and a photoreceptor and the step of activating selected copy sheet drives of said plurality of copy sheet drives in order to adjust the spacing of the copy sheet from the next downstream copy sheet includes the step of activating selected copy sheet drives to insure correct timing of arrival of copy sheets at the photoreceptor at the image transfer station.

4. In an image processing apparatus for producing images on copy sheets including a copy sheet path having a plurality of segments, the segments being coupled at given transfer zones, a plurality of copy sheet drives, and a controller for directing the image processing apparatus, a method of adjusting spacing between copy sheets at each of said segments along the copy sheet path comprising the steps of:

monitoring a plurality of the transfer zones for the presence of copy sheets, deciding to change the speed of selected copy sheet drives relating to a selected segment if the presence of copy sheets is determined at a given transfer zone to synchronize the speed of copy sheet drives between the two segments at said given transfer zone, and deciding to change the speed of selected copy sheet drives relating to a selected segment if the presence of copy sheets is not determined at a given transfer zone of said plurality of transfer zones to adjust the spacing between adjacent copy sheets in said selected segment.

5. The method of claim 4 wherein the step of deciding to change the speed of selected copy sheet drives if the presence of copy sheets is determined at a given transfer zone includes the step of deciding to speed up or slow down adjacent copy sheet drives.

6. The method of claim 4 wherein the step of deciding to change the speed of selected copy sheet drives if the presence of copy sheets is not determined at a given transfer zone includes the step of deciding by the controller to speed up or slow down adjacent copy sheet drives to adjust copy sheet spacing at said selected segment.

7. In an image processing apparatus for producing images on copy sheets including a copy sheet path having a plurality of segments, the segments being coupled at given transfer zones, an image transfer station, a photoreceptor and a controller for directing the image processing apparatus, a method of adjusting spacing between copy sheets at each of said plurality of segments along the copy sheet path comprising the steps of:

tracking the movement of copy sheets at the image transfer station in relation to the movement of the photoreceptor, monitoring the movement of copy sheets at said given transfer zones, determining the need to adjust the spacing of copy sheets along selected segments of said plurality of segments, and activating selected copy sheet drives of said plurality of copy sheet drives for synchronization of the copy sheets with the photoreceptor.

8. The method of claim 7 including the step of determining correct spacing of copy sheets from next downstream copy sheets and maintaining the speed of upstream copy sheets in step with the speed of downstream copy sheets.

9. The method of claim 7 including the step of determining the need to adjust the speed of copy sheets along said plurality of the given transfer zones.

* * * * *